United States Patent [19]

Yamamoto

[11] Patent Number: 5,020,764

[45] Date of Patent: Jun. 4, 1991

[54] POLE BALLASTING DEVICE

[75] Inventor: Tadayuki Yamamoto, Suzuka, Japan

[73] Assignee: Yamamoto Co., Ltd., Suzuka, Japan

[21] Appl. No.: 467,163

[22] Filed: Jan. 19, 1990

[30] Foreign Application Priority Data

Jan. 23, 1989 [JP] Japan ..... 1-13627

[51] Int. Cl.[5] ..... F16M 13/00

[52] U.S. Cl. ..... 248/529; 248/910

[58] Field of Search ..... 248/688, 677, 511, 512, 248/513, 519, 529, 150, 188.1, 188.8, 188.9, 313, 314, 910, 500, 501, 502; 47/41.13; 52/297, 298; 135/116, 120; 220/4 B, 4 E, 345, 428

[56] References Cited

U.S. PATENT DOCUMENTS

| | | | |
|---|---|---|---|
| 3,841,631 | 10/1974 | Dolan | 248/910 |
| 4,145,044 | 3/1979 | Wilson | 248/910 |
| 4,219,176 | 8/1980 | Weiss | 248/910 |
| 4,521,464 | 6/1985 | Chapman | 220/4 E |
| 4,591,126 | 5/1986 | Berney | 248/910 |

FOREIGN PATENT DOCUMENTS

| | | | |
|---|---|---|---|
| 994741 | 8/1976 | Canada | 248/910 |
| 391977 | 9/1965 | Switzerland | 248/910 |

*Primary Examiner*—Ramon O. Ramirez
*Assistant Examiner*—Robert A. Olson
*Attorney, Agent, or Firm*—Dennison, Meserole, Pollack & Scheiner

[57] ABSTRACT

A pole ballasting device adapted to be positioned about the lower end of one or more poles of a pole-using temporary structure for the purpose of holding the poles. The device includes at least two discrete blocks having, in their assembled condition, one or more common vertically extending through holes for receiving the poles therethrough. The blocks are arranged along planes passing through the through holes. A joining mechanism is provided for separably joining the blocks into a unit. A container is formed in at least one of the blocks and adapted to contain a fluidic load therein.

13 Claims, 9 Drawing Sheets

POLE BALLASTING DEVICE

BACKGROUND OF THE INVENTION

1. Field of the Invention

The present invention relates to a pole ballasting device for facilitating stable erection of poles, and more particularly to such a device for preventing poles of temporary structures using poles, such as tents, parasols, signboards, gates, banners and flags, from being blown down by wind or other external force.

2. Description of the Prior Art

In general, many temporary structures using poles (hereinafter referred to as pole-using temporary structures) are arranged in event sites, including the above noted temporary tents. Take a temporary tent for example, it may be comprised of a framework which includes poles, beam members and frame members connected to each other, and of sheets to cover the framework.

Such temporary tents will eventually be removed from the sites when events are closed, and therefore, it is desirable for these tents to be readily removed. However, when the poles are rested simply on the ground or the like, the tents can sometimes be blown by a strong wind or a gust and thence, the poles will have to be ballasted so that they can withstand winds.

Conventionally, in order to ballast poles of a tent, an anchor pile is passed through a hole formed in the base of each pole and is driven into the ground. Alternately, a pile is driven into the ground adjacent to the pole, and the edge of the tent sheet is drawn to the pile through a rope, so that the pole can be indirectly ballasted. However, such a pile tends to be easily extracted and is unreliable in use. Further, on asphalt, concrete, tiled or bricked surfaces, such piling is sometimes difficult. In such cases, weights such as sandbags and concrete blocks are heaped around the base of the poles so as to support the same. However, the heap of sandbags or concrete blocks is unpleasant to look at and spoils the appearance, and furthermore, it may sometimes collapse, resulting in poor reliability in its strength.

SUMMARY OF THE INVENTION

It is, accordingly, an object of the present invention to provide a pole ballasting device which may reliably secure poles of pole-using temporary structures such as tents and signboards even to surfaces where piles can not be driven.

It is another object of the present invention to provide a pole ballasting device which is pretty and yet reliable.

It is a further object of the present invention to provide a pole ballasting device which may be readily assembled and disassembled, and which may be readily transported.

It is a still further object of the present invention to provide a pole ballasting device which includes containers for containing a fluidic load such as water, so that the overall weight of the device may be increased to thereby reliably ballast the poles.

According to the present invention, there is provided a pole ballasting device adapted to be positioned about the lower end of one or more poles of a pole-using temporary structure for the purpose of holding the poles. The device includes at least two discrete blocks having, in their assembled condition, one or more common vertically extending through holes for receiving the poles therethrough. The blocks are arranged along planes passing through the through holes. A joining mechanism is provided for separably joining the blocks into a unit. A container is formed in at least one of the blocks and adapted to contain a fluidic load therein.

The discrete blocks are assembled into a unit so as to surround the poles. Further, in each of the blocks, a fluidic load such as water may be contained so that the increased weight of the device can act on the base of the pole, thereby more reliably ballasting the pole. When the device is disassembled into the discrete blocks and when the fluidic load is discharged from each block, the weight of the blocks may be reduced to the extent that they may be readily transported.

The invention will become more fully apparent from the claims and the description as it proceeds in connection with the drawings.

DETAILED DESCRIPTION OF THE PREFERRED EMBODIMENTS

Figure 1:
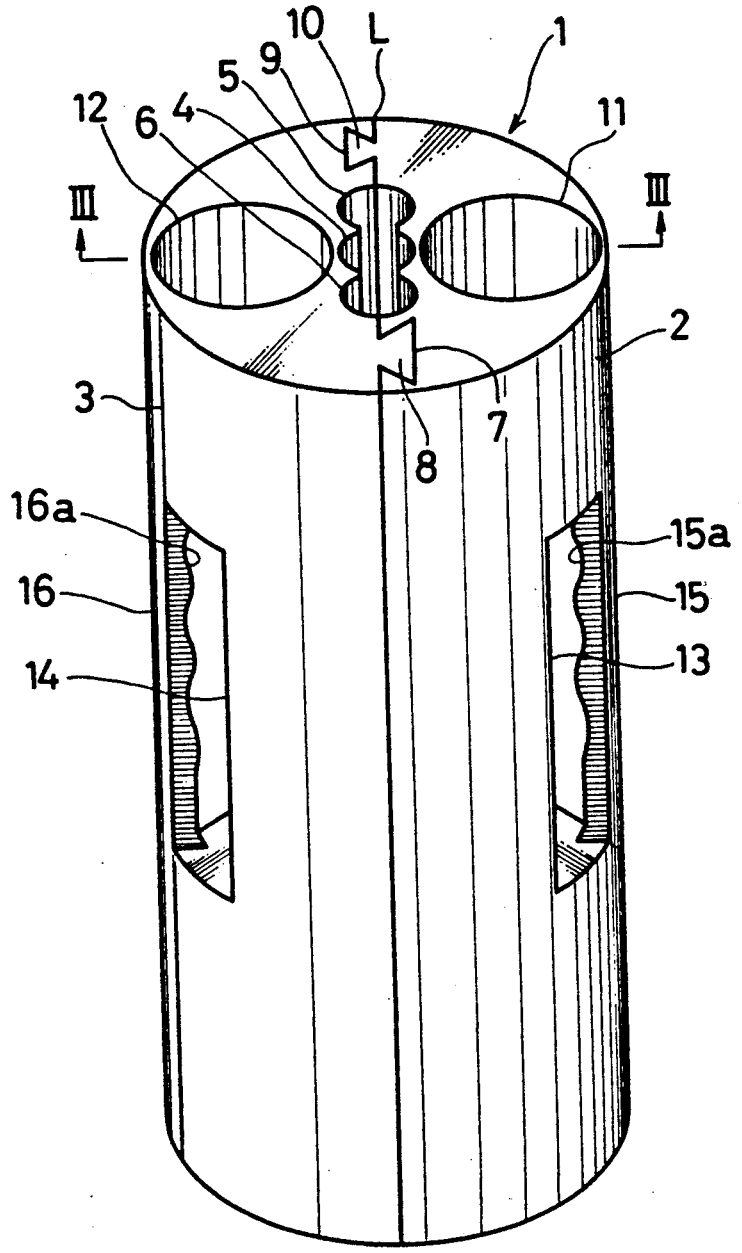
FIG. 1 is a perspective view of a pole ballasting device according to a first embodiment of the present invention.

Referring now to the drawings and to FIG. 1 in particular, shown therein is a pole ballasting device 1 according to a first embodiment of the present invention. As shown therein, the ballasting device 1 is of a generally cylindrical configuration and is separable into two discrete parts 2 and 3 in a plane L (hereinafter referred to as interface) in whIch the central axis of the ballasting device 1 is contained. The ballasting device 1 has a through hole 4 vertically extending along the central axis thereof and adapted to receive a pole. In this embodiment, the ballasting device 1 has additional two through holes 5 and 6 also vertically extending on either side of the through hole 4. These through holes 4, 5 and 6 are aligned in parallel on the interface L and have respective adjacent sides communicating with one another so as to form a triplet hole.

Figure 2:
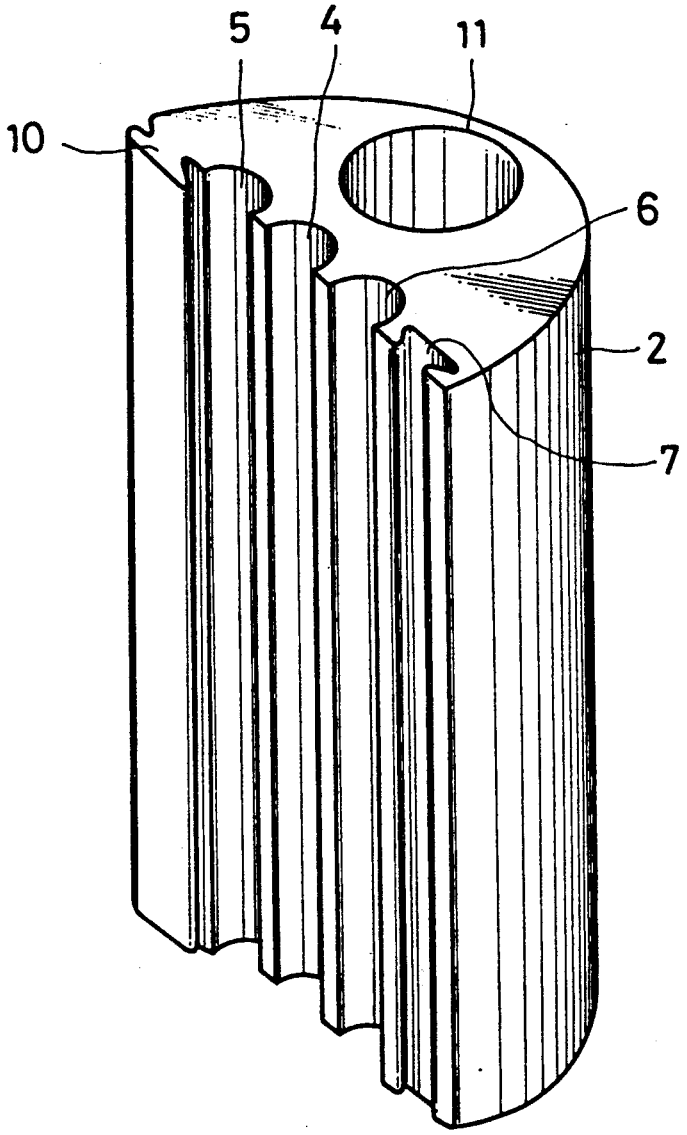
FIG. 2 is a perspective view of one of the discrete blocks of the device in FIG. 1.

As shown in FIGS. 1 and 2, the discrete Parts 2 and 3 (hereinafter referred to as right block 2 and left block 3) have respective dovetail grooves 7 and 9 and dovetail tenons 8 and 10 extending in the vertical direction of the interface L substantially over the entire length thereof. The dovetail grooves 7 and 9 and the dovetail tenons 8 and 10 are provided outside of the through holes 5 and 6 and symmetrically arranged with respect to the through hole 4 in the interface L. Specifically, the right block 2 is formed with the dovetail groove 7 and the dovetail tenon 10, while the left block 3 is formed with the dovetail tenon 8 and the dovetail groove 9. The dovetail tenons 8 and !0 are engageable with the corresponding dovetail grooves 7 and 9 to join the right block 2 and the left block 3 into a unit.

The right and left blocks 2 and 3 are further formed on the upper surfaces thereof with respective circular deep holes 11 and 12 arranged symmetrically with respect to the interface L. The deep holes 11 and 12 have such a diameter and depth as to permit insertion of a hand of a man. The right and left blocks 2 and 3 have respective recesses 13 and 14 formed also symmetrically with respect to the interface L in the side surfaces of the blocks at positions slightly higher than the central portions thereof and having such a vertical length and depth as to permit insertion of human hands. These recesses 13 and 14 are provided with grips 15 and 16 vertically extending along the central lines of the recesses 13 and 14 as seen from the front thereof. The grips 15 and 16 are formed on the inside surfaces thereof with corrugated portions 15*a* and 16*a* of the form corresponding to the shape of the gripping hands.

Figure 4:
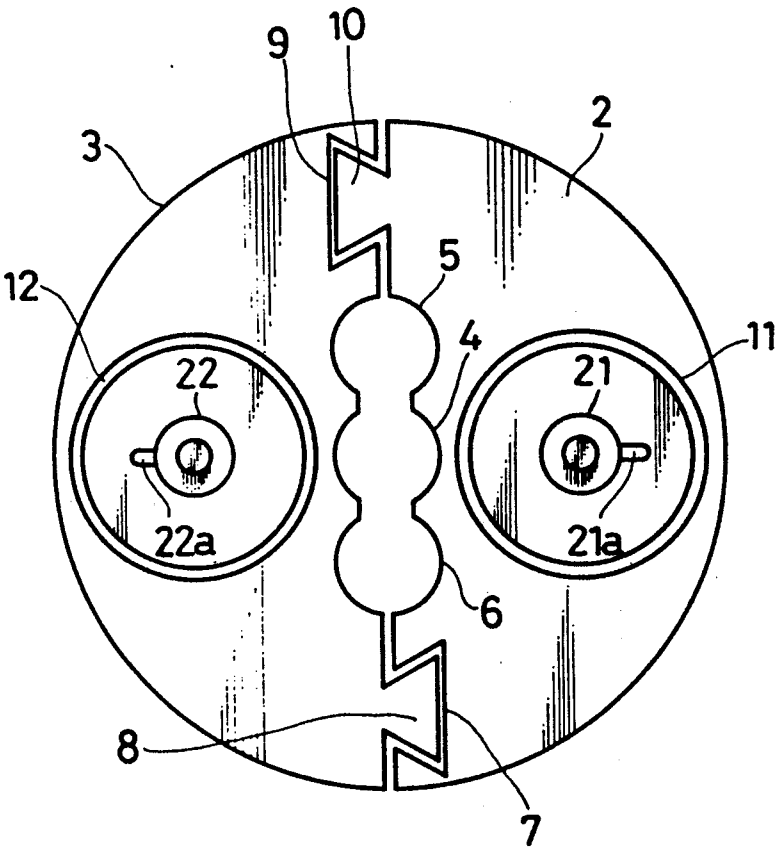
FIG. 4 is a plan view of the ballasting device in FIG. 1.
Figure 3:
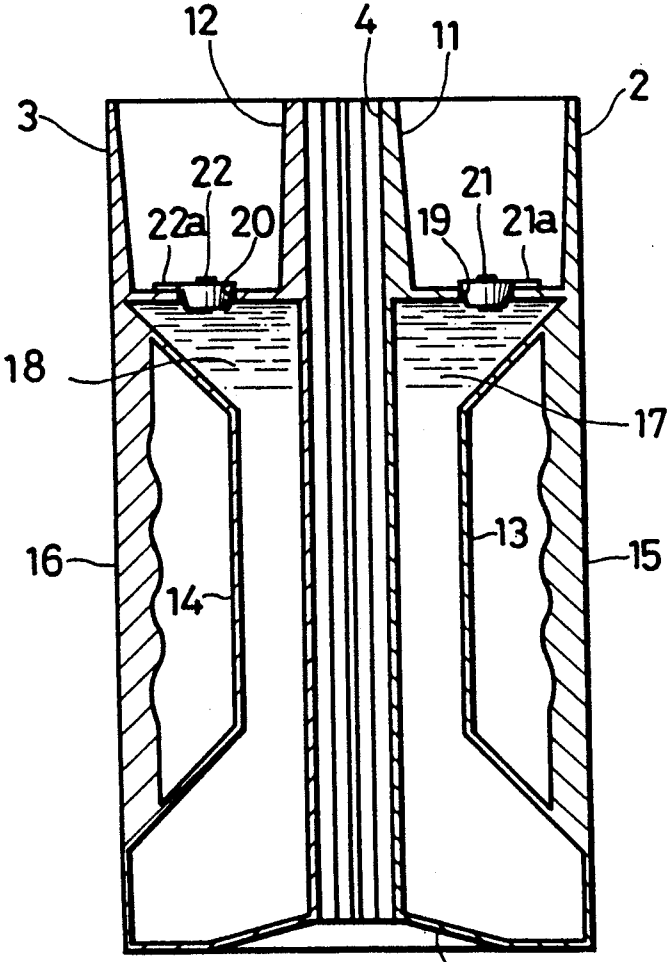
FIG. 3 is a vertical sectional view taken along the line III—III in FIG. 1.

As shown in FIG. 3, the right block 2 and the left block 3 include respective hollow containers 17 and 18 formed therewithin. The containers 17 and 18 define hollow spaces extending from the bottom of the deep holes 11 and 12 to the bottom of the blocks 2 and 3 and are adapted to contain liquid such as water so as to increase the weight of the ballasting device 1 and consequently, the stability of the pole. The containers 17 and 18 have respective openings 19 and 20 formed in the upper surfaces thereof. The openings 19 and 20 are located at the central portions of the bottom of the deep holes 11 and 12 and can be tightly closed by sealing plugs 21 and 22, respectively, as shown in FIGS. 3 and 4. The sealing plugs 21 and 22 are provided with tongs 21*a* and 22*a*, respectively, projecting from a portion of the side edges thereof for facilitating removal of the plugs 21 and 22.

Usually, poles have a disk-like foot plate formed at the lower ends thereof so that they may be placed stably on an asphalt, tiled or bricked surface. Thus, in order to receive such foot plates, the ballasting device 1 has three recesses 23 (only one of which is shown in FIG. 3) formed on the bottom of the right and left blocks 2 and 3 around the through holes 4, 5 and 6.

The blocks 2 and 3 of the ballasting device 1 are made of synthetic plastic material such as polypropylene. The dead weight of each block is about 1.1 kg. When the two blocks 2 and 3 are joined to form the unitary ballasting device 1, its height is about 500 mm and its diameter is about 250 mm. Further, with the containers 17 and 18 filled with water, the total weight of the device 1 is 20 kg. Of course, this weight can be adjusted by reducing the amount of water to be charged in the blocks 2 and 3 to suit the use and type of poles.

The operation of the pole ballasting device 1 of the first embodiment will now be described with reference to FIG. 5.

Figure 5:
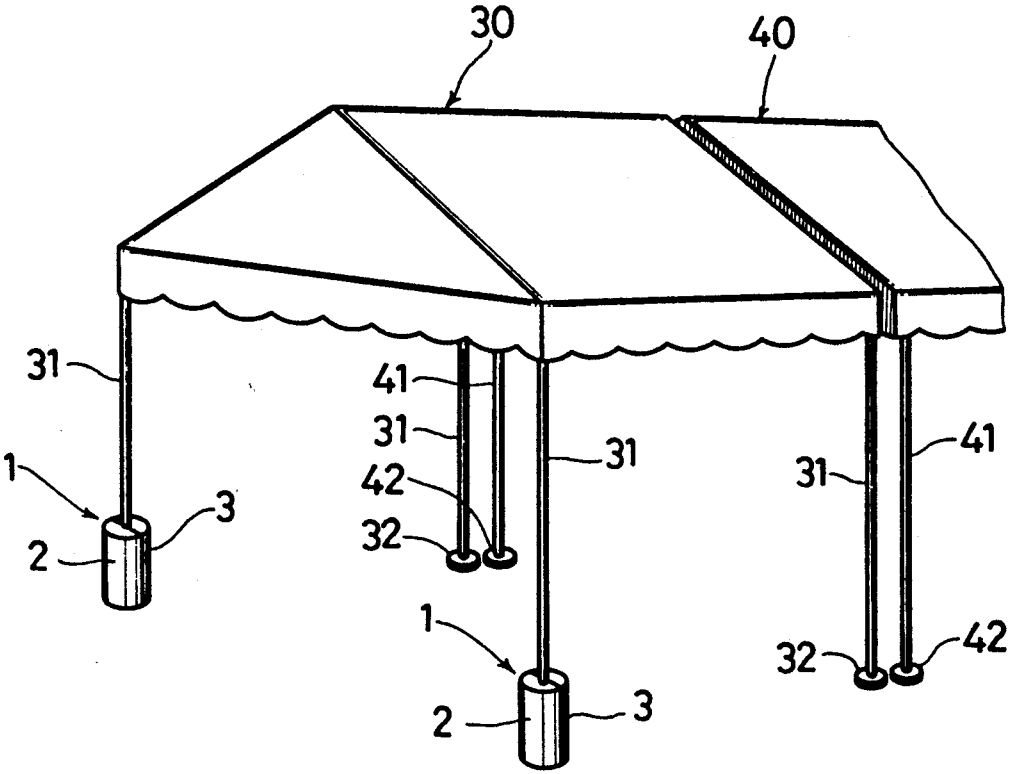
FIG. 5 is a schematic view illustrating the ballasting device in FIG. 1 used for supporting poles of tents.

As shown in FIG. 5, tents 30 and 40 are pitched, and the pole ballasting devices 1 are used for supporting poles 31 and 41 of the tents 30 and 40, respectively. First, a description will be given as to the procedure to mount one ballasting device 1 to one pole 31.

After the poles 31 and 41 of the tents 30 and 40 are erected, the discrete right and left blocks 2 and 3 of the ballasting device 1 are disposed on both sides of the base portion of the pole 31, and then the dovetail tenons 8 and 10 are slidingly inserted into the dovetail grooves 7 and 9, respectively, so as to join the right and left blocks 2 and 3 into a unit. In this case, as the single pole 31 is to be supported by the ballasting device 1, the pole 31 is inserted into the central through hole 4. Thus, the ballasting device 1 becomes a unitary block surrounding the base portion of the pole 31. Then, the inner containers 17 and 18 of the blocks 2 and 3 are charged through the openings 19 and 20 with liquid such as water so as to increase the weight of the ballasting device 1 and consequently, the stability of the pole 31.

When the poles 31 and 41 are erected on an asphalt, tiled or bricked surface, disk-like foot plates 32 and 42 are usually provided at the lower ends of the poles 31 and 41. In this case, the ballasting device 1 is placed on the foot plate 32 so as to prevent the tent 30 from being blown down by wind and consequently to increase the stability of the tent 30. Further, the ballasting device 1 is free from collapse which would occur in using sandbags or concrete blocks.

When two adjacent poles 31 and 41 are supported, it is practically difficult to apply each one ballasting device 1 to the poles 31 and 41, respectively, since they are disposed closely to each other. In this case, the poles 31 and 41 are respectively inserted into the through holes 5 and 6 provided on both sides of the central through hole 4, so that the two poles 31 and 41 are supported by one ballasting device 1. The distance between the two through holes 5 and 6 are so determined as to permit possible superposition of the foot plates 32 and 42 provided at the lower ends of the poles 31 and 41. Thus, the foot plates 32 and 42 causes no interference with insertion of the poles 31 and 41 into the through holes 5 and 6.

In case provision of a single ballasting device 1 around a pole cannot impart sufficient stability under a strong wind condition, a plurality of ballasting devices 1 can be laid one on another so as to increase the total weight.

In striking the tents 30 and 40, the ballasting device 1 is separated into the right and left blocks 2 and 3 through disengagement of the dovetail tenons 8 and 10 from the dovetail grooves 7 and 9, so that it can be easily removed from the pole. The sealed plugs 21 and 22 are removed to discharge the liquid within the ballasting device 1, which now becomes light enough to be easily transported.

Figure 6:
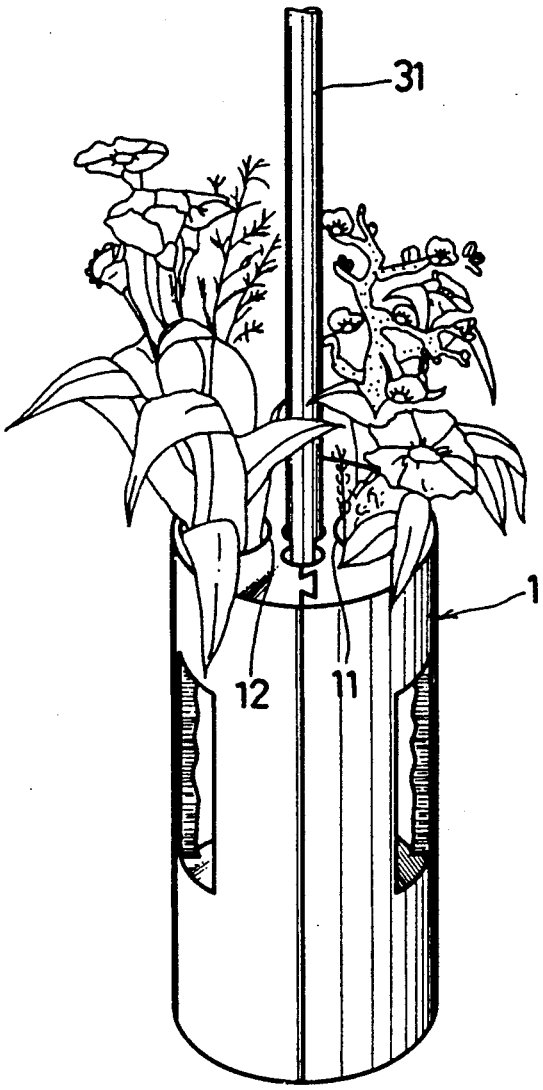
FIG. 6 is a perspective view of the ballasting device in FIG. 1 used in another way.

The ballasting device 1 of the present invention is, of course, nicer to look at than the heaPed sandbags or concrete blocks, and as shown in FIG. 6, cup-shaped vessels (not shown) may be fitted in the deep holes 11 and 12 and filled with water in which flowers are arranged for further improving appearance. In place of the cups, ashtrays may be fitted in the deep holes 11 and 12 for receiving embers of tobacco.

A second embodiment of the present invention will now be described with reference to FIGS. 7 to 13. Parts that are the numbers and their description will not be repeated.

Figure 8:
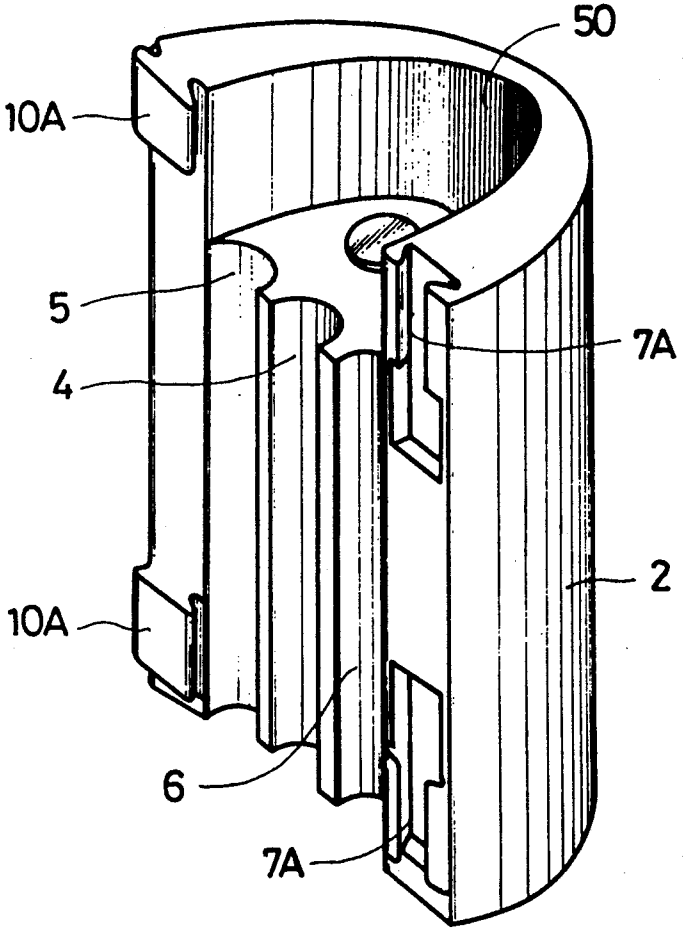
FIG. 8 is a perspective view of one of the discrete blocks of the device according to the second embodiment.
Figure 7:
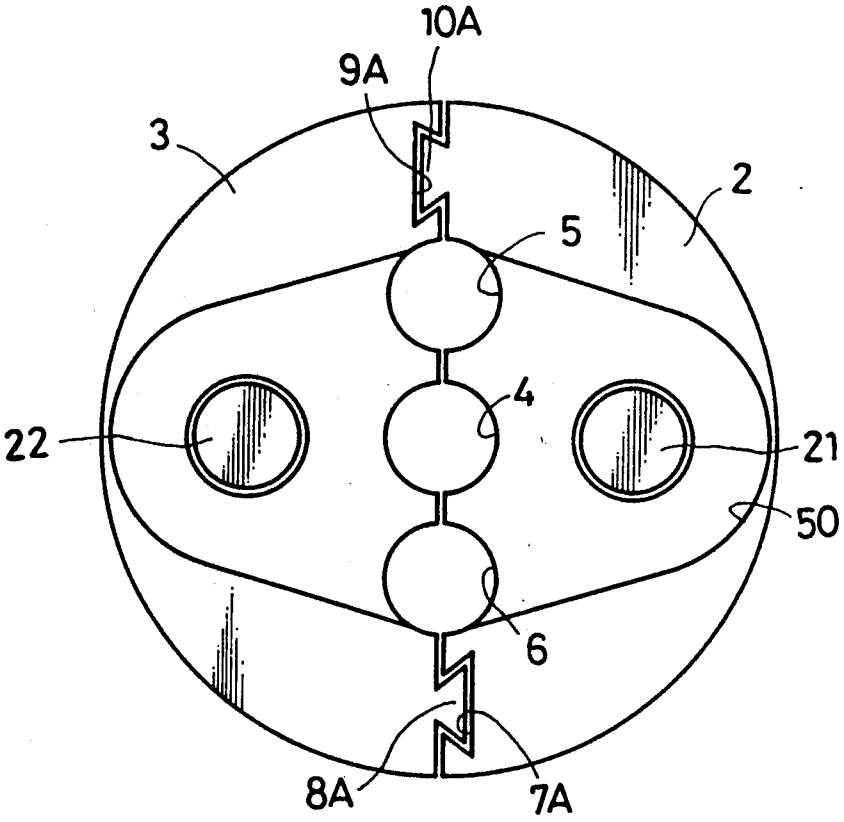
FIG. 7 is a plan view of a pole ballasting device according to a second embodiment of the present invention.

The second embodiment differs from the first embodiment in two respects. First, as shown in FIGS. 7 and 8, the second embodiment includes alternative dovetail grooves 7A and 9A and dovetail tenons 8A and 10A formed partially on the upper and lower ends of the blocks 2 and 3 in spaced-apart relation, rather than the dovetail grooves 7 and 9 and the dovetail tenons 8 and 10 extending substantially over the entire length of the blocks 2 and 3 as in the first embodiment.

Another difference is that each of the blocks 2 and 3 is provided on the upper surface thereof with a recess of substantially U-shaped configuration in plan. The recesses of the blocks 2 and 3 are disposed in symmetrical relation to each other, and when the blocks 2 and 3 are joined, the recesses form a substantially oval deep hole 50, as shown in FIG. 7. Thus, the sealing plugs 21 and 22 of the blocks 2 and 3 are located on the bottom of the hole 50.

Figure 10:
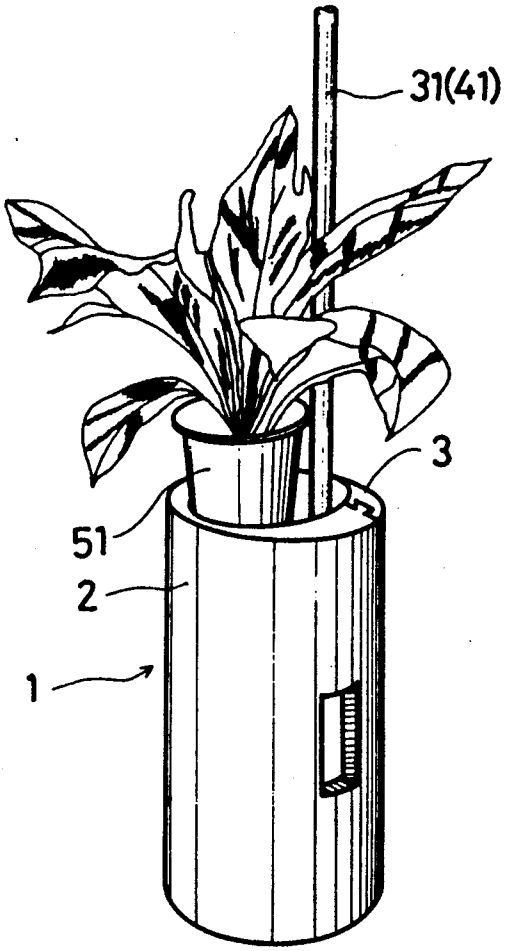
FIG. 10 is a perspective view of the device in FIG. 9, with a flowerpot thereon.
Figure 9:
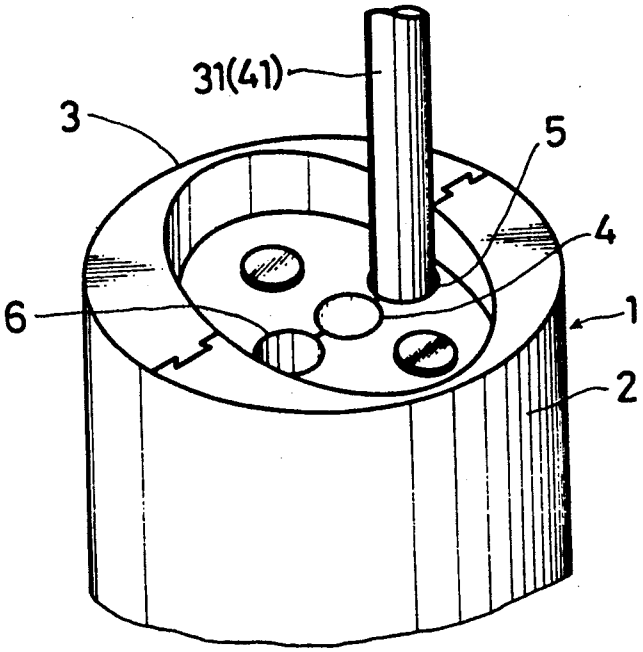
FIG. 9 is a perspective view of the device holding a single pole, with a portion cut away.
Figure 13:
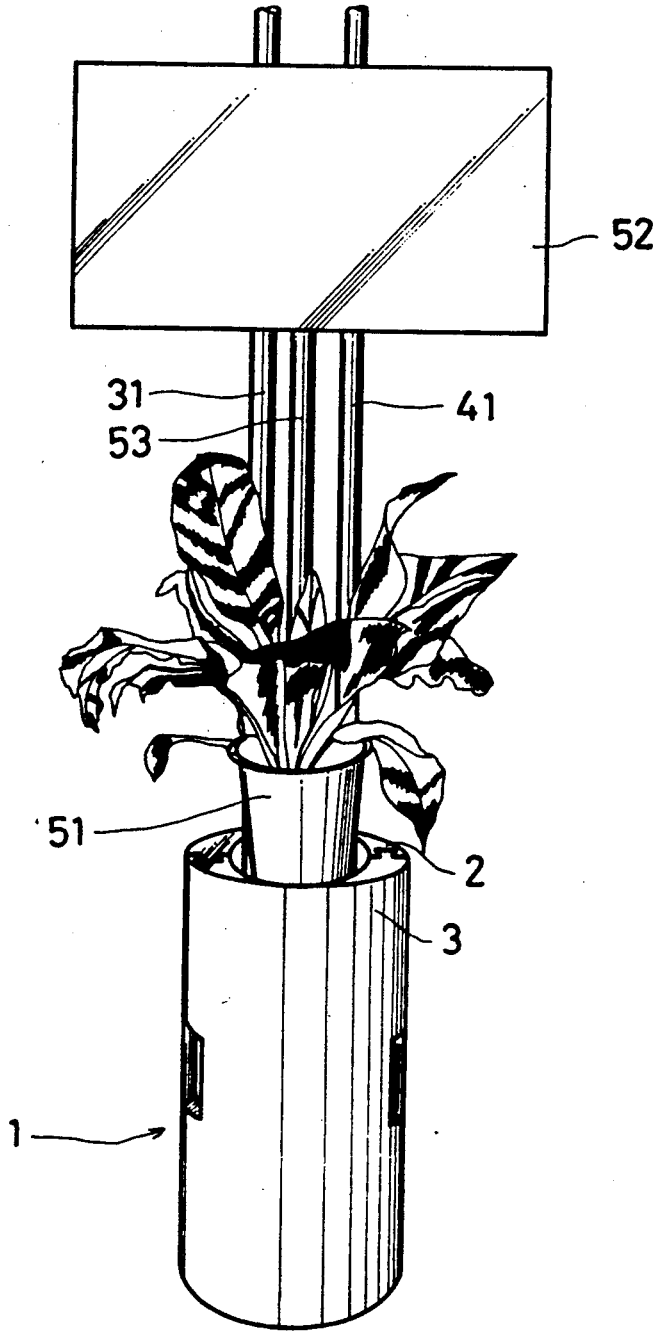
FIG. 13 is a perspective view similar to FIG. 12, with a flowerpot/thereon.
Figure 12:
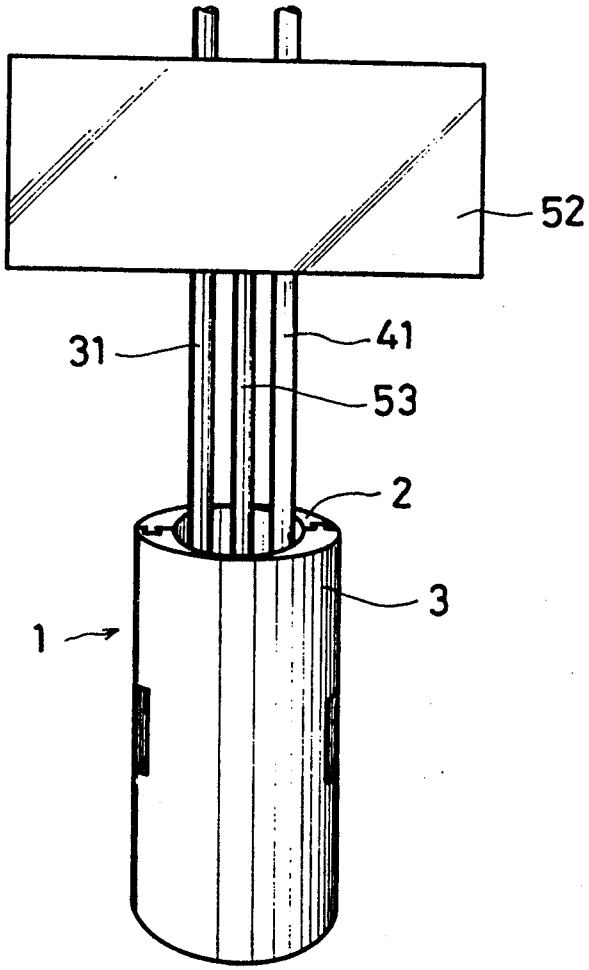
FIG. 12 is a perspective view of the device in FIG. 11, with an additional pole on a signboard inserted in the central through hole.
Figure 11:
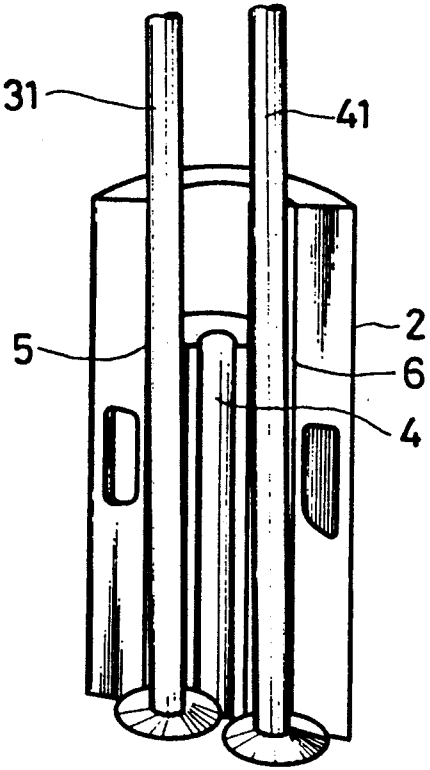
FIG. 11 is a perspective view of the device holding two poles, with one block removed.

The hole 50 has its minor axis in the direction of interface of the blocks 2 and 3 and has its major axis in the direction perpendicular to the minor axis. When one pole 31 or 41 is inserted in the through hole 5 for example (FIG. 9), a flowerpot 51 may be placed on the minor axis passing through the through holes 4 and 6 (FIG. 10). In addition, when two poles 31 and 41 are inserted in the through holes 5 and 6 (FIG. 11), a similar flowerpot 51 may be placed on the major axis adjacent the sealing plug 21 or 22 (FIG. 13). Further, when two poles 31 and 41 are inserted in the through holes 5 and 6, a pole 53 of a signboard 52 may be inserted into the central through hole 4, as shown in FIGS. 12 and 13.

The present invention is not limited to the above embodiments, and various changes in the details which have been described with reference to the above embodiments may be made. For example, the outer and inner configurations of the ballasting device 1 may be other than those in the above embodiments, and the through hole may be constituted only by a central one. Though the ballasting device 1 of the above embodiments is separable into two parts, it may be designed to be separable into three parts or more. The connection of the parts which is achieved through the dovetail joint in the above embodiments may be provided by other connecting means such as banding and latching. In addition, in place of liquid, the containers 17 and 18 may be charged with granular material such as sand and gravel. Further, in addition to the openings 19 and 20 and the sealed plugs 21 and 22 provided in the upper surfaces of the containers 17 and 18, such openings and sealed plugs may be provided in the lower portions of the containers, so that the load within the containers may be discharged through the lower openings. In case of loads of liquid, however, it is preferable to provide only the upper openings so as to eliminate any possibility of leakage. The plugs 21 and 22 are not essential to the invention and therefore, they may be omitted.

Though the ballasting device of the present invention is used to support poles of tents as described in the above embodiments, it can be widely used to support poles of various pole-using temporary structures such as signboards and bulletin boards.

What is claimed is:

1. A pole ballasting device adapted to be positioned about the lower end of at least one pole of a pole-using temporary structure for the purpose of holding the at least one pole, comprising:

at least two discrete blocks having, in their assembled condition, at least one common vertically extending through hole for receiving the at least one pole therethrough, said discrete blocks being arranged along planes passing through said at least one through hole;

means for separately joining said discrete blocks into a unit; and a container formed in at least one of said discrete blocks and adapted to contain a fluidic load therein;

said discrete blocks having upper surfaces and forming a common recess in said upper surfaces thereof, said recess including said at least one through hole therein and serving to receive a beauty-adding accessory such as a flowerpot outward of each through hole through which a pole is passed.

2. A pole ballasting device adapted to be positioned about the lower end of at least one pole of a pole-using temporary structure for the purpose of holding the at least one pole, comprising:

at least two discrete blocks having, in their assembled condition, at least one common vertically extending through hole for receiving the at least one pole therethrough, said discrete blocks being arranged along planes passing through said at least one through hole;

means for separately joining said discrete blocks into a unit; and a container formed in at least one of said discrete blocks and adapted to contain a fluidic load therein;

said joining means comprising a combination of projections and grooves formed on said discrete blocks and engageable by moving said discrete blocks relative to each other along the axial direction of the pole.

3. A pole ballasting device adapted to be positioned about the lower end of at least one pole of a pole-using temporary structure for the purpose of holding the at least one pole, comprising:

at least two discrete blocks having, in their assembled condition, at least one common vertically extending through hole for receiving the at least one pole therethrough, said discrete blocks being arranged along planes passing through said at least one through hole;

means for separately joining said discrete blocks into a unit; and a container formed in at least one of said discrete blocks and adapted to contain a fluidic load therein;

said container having an upper surface, and an opening formed in said upper surface thereof for selectively charging and discharging a fluidic load therethrough and a plug removably mounted to the opening.

4. A pole ballasting device for lateral positioning about the lower end of a vertical pole of a pole-using temporary structure for the purpose of stabilizing the pole, and comprising:

at least two discrete blocks adapted to assemble about and encircle the pole, said blocks, in an assembled condition, meeting along a vertical interface and having a common vertically extending through hole formed therebetween at said interface and sized to receive the pole therethrough, means for releasably joining said discrete blocks into a unitary assembly about the pole for selective disassembly for removal of said discrete blocks from the pole for repeated reuse; and at least one of said discrete blocks having a hollow container defined completely therein for selectively receiving, retaining and discharging a fluidic load independently of another of said discrete blocks.

5. The device as defined in claim 4 wherein each of said discrete blocks has a recess therein, and an integral grip formed within said recess and adapted to be grasped by a user.

6. The device as defined in claim 4 wherein said means for joining said discrete blocks comprises a combination of projections and grooves formed on said discrete blocks and engageable by moving said discrete blocks relative to each other along the axial direction of the pole.

7. The device as defined in claim 4 wherein each of said blocks having a container therein further having an upper surface with a hole therein, said hole having a bottom therein overlying said container, an opening through said bottom and into said container for charging and discharging the fluidic load therethrough, and a plug removably mounted to the opening.

8. A pole ballasting device for lateral positioning about the lower end of a vertical pole of a pole-using temporary structure for the purpose of holding the pole, the pole having a disk-like foot plate formed at the lower end thereof for seating said pole ballasting device thereon, said ballasting device comprising:

at least two discrete blocks adapted to assemble about the pole above the foot plate, said blocks, in an assembled condition, meeting along a vertical interface and having a common vertically extending through hole formed therebetween at said interface and sized both to receive the pole therethrough and to preclude passage of the foot plate therethrough, means for releasably joining said discrete blocks into a unitary assembly about the pole for selective disassembly for removal of said discrete blocks from the pole; and a container formed in at least one of said discrete blocks and means for charging said container with a fluid load and for discharging said fluidic load from said container.

9. The device as defined in claim 8 wherein said discrete blocks are formed of synthetic plastic material.

10. The device as defined in claim 8 wherein at least one of said discrete blocks has an upper surface and a recess formed in said upper surface thereof and adapted to receive a beauty-adding accessory such as a flowerpot.

11. The device as defined in claim 8 wherein each of said discrete blocks has an integral grip formed on the side thereof and adapted to be held by a user.

12. The device as defined in claim 8 wherein said through holes are three in number, and wherein when one pole is ballasted, one of three holes is used to receive the pole therein, and when two poles are ballasted, two of three holes which are remotest from one another are used to receive the two poles, respectively.

13. The device as defined in claim 12 wherein a remaining one of said three holes is used to support a pole of a different temporary structure.

* * * * *